US007835685B2

(12) United States Patent
Osari et al.

(10) Patent No.: US 7,835,685 B2
(45) Date of Patent: Nov. 16, 2010

(54) IMAGE FORMING APPARATUS AND CONTROL METHOD THEREFOR

(75) Inventors: Yoshihito Osari, Tokyo (JP); Eiichi Motoyama, Tokyo (JP); Kuniyasu Kimura, Toride (JP); Hiroaki Tomiyasu, Toride (JP); Takahiko Yamaoka, Kashiwa (JP); Yuichi Yamamoto, Abiko (JP)

(73) Assignee: Canon Kabushiki Kaisha (JP)

( * ) Notice: Subject to any disclaimer, the term of this patent is extended or adjusted under 35 U.S.C. 154(b) by 854 days.

(21) Appl. No.: 11/442,946

(22) Filed: May 30, 2006

(65) Prior Publication Data

US 2006/0269340 A1 Nov. 30, 2006

(30) Foreign Application Priority Data

May 31, 2005 (JP) ..... 2005-159860

(51) Int. Cl.
*G03G 15/00* (2006.01)

(52) U.S. Cl. ..... 399/401; 399/388; 399/389; 399/394; 399/402; 271/242

(58) Field of Classification Search ..... 399/388, 399/389, 394, 401, 402; 271/242
See application file for complete search history.

(56) References Cited

U.S. PATENT DOCUMENTS

| | | | | |
|---|---|---|---|---|
| 5,473,419 | A * | 12/1995 | Russel et al. | 399/130 |
| 6,330,425 | B1 | 12/2001 | Ohuchi et al. | |
| 6,577,844 | B2 | 6/2003 | Kamei | |
| 2002/0061215 | A1* | 5/2002 | Kamei | 399/401 |
| 2004/0052563 | A1* | 3/2004 | Hayamizu et al. | 399/401 |
| 2006/0269300 | A1 | 11/2006 | Motoyama | |
| 2008/0205913 | A1 | 8/2008 | Motoyama | |

FOREIGN PATENT DOCUMENTS

| | | | |
|---|---|---|---|
| JP | 63-208467 | A | 8/1988 |
| JP | 5-131696 | A | 5/1993 |
| JP | 10-157212 | A | 6/1998 |

(Continued)

OTHER PUBLICATIONS

Related co-pending U.S. Appl. No. 12/105,935, Eiichi Motoyama et al.; "Image Forming Apparatus and Control Method Therefor", filed Apr. 18, 2008; Spec. pp. 1-37; Figs. 1-9.

*Primary Examiner*—Judy Nguyen
*Assistant Examiner*—Andy L Pham
(74) *Attorney, Agent, or Firm*—Rossi, Kimms & McDowell LLP

(57) ABSTRACT

An image forming apparatus capable of reducing a part of a sheet exposed outside the apparatus on standby after finishing printing a first side in both-sided printing. A transfer material P having an image formed on its first side is fed until a part thereof gets exposed outside a full-color printer 1 and is fed to a refeeding path in the full-color printer 1. The transfer material P inverted by a flapper 44 is fed to a standby position to form an image on a second side thereof and is stopped there. In the case where a preparation for forming the image on the second side is not completed, the standby position for having the transfer material P stopped is changed corresponding to length of the inverted transfer material P in a feeding direction.

6 Claims, 11 Drawing Sheets

FOREIGN PATENT DOCUMENTS

| | | | |
|---|---|---|---|
| JP | 11-288197 | A | 10/1999 |
| JP | 2001-063152 | A | 3/2001 |
| JP | 2001-305918 | A | 11/2001 |
| JP | 2001-335216 | A | 12/2001 |
| JP | 3334481 | B2 | 8/2002 |
| JP | 2003-175656 | A | 6/2003 |
| JP | 2004-085624 | A | 3/2004 |
| JP | 2005-125678 | A | 5/2005 |

* cited by examiner

IMAGE FORMING APPARATUS AND CONTROL METHOD THEREFOR

BACKGROUND OF THE INVENTION

1. Field of the Invention

The present invention relates to an image forming apparatus and a control method therefor, and more particularly, to an image forming apparatus such as a copying machine or a printer for performing both-sided printing and a control method therefor.

2. Description of the Related Art

Conventionally, there has been a known printer for performing both-sided printing by inverting a sheet after finishing printing a first side of the sheet to print the second side thereof. Such a printer puts the inverted sheet on standby on a paper path in the case where, after finishing printing the first side, it cannot start printing the second side in predetermined timing for a reason such as delay in image development of an image to be formed on the second side. In many cases, such a printer has length of the paper path designed to be short for the sake of miniaturizing the printer, and a part of the sheet is thus exposed outside the printer on inverting-the sheet.

In the case where the printer cannot start printing the second side in the predetermined timing after finishing printing the first side, it puts the sheet on standby in a state of having a part of the sheet exposed outside the printer. For that reason, in the case where a sheet of a large size such as A3 size is put on standby in particular, the part of the sheet exposed outside the printer on standby is so large that a user may judge that a print job is finished and mistakenly pull out the sheet.

Thus, there is a proposed technique of passing a hold current through a motor for driving a roller holding the sheet tightly when putting the sheet on standby so as to prevent the roller from rotating in a direction of pullout (refer to Japanese Patent No. 3334481 for instance).

As for the technique described in Japanese Patent No. 3334481, however, the part of the sheet exposed outside the printer on standby is so large that the user cannot recognize the ongoing print job. To be more specific, it is not possible to prevent the user form pulling out the sheet on standby. For that reason, there are the cases where, as the user tires to pull out the sheet on standby after finishing printing the first side, an image forming position on the sheet becomes displaced from a proper position where the image should be formed and so the printing on the second side is not normally performed.

SUMMARY OF THE INVENTION

It is therefore an object of the present invention to provide an image forming apparatus capable of reducing a part of a sheet exposed outside the apparatus on standby after finishing printing a first side in both-sided printing and a control method therefor.

To attain the above object, a first aspect of the present invention provides the image forming apparatus comprising a-paper feeding device that feeds a transfer material a receiving device that receives image data, an image forming device that forms an image on a first side or a second side of the fed transfer material based on the image data received by the receiving device, an inversion device that feeds the transfer material having the image formed on its first side until a part of the transfer material gets exposed outside the image forming apparatus and then feeds the transfer material to a refeeding path in the image forming apparatus, a refeeding device that feeds the transfer material inverted by the inversion device to a standby position to form the image on the second side of the transfer material and stops it there, a determining device that determines whether or not a preparation for forming the image on the second side of the transfer material is completed, and a refeeding controlling device that, in the case where the preparation for forming the image on the second side of the transfer material is not completed, changes the standby position where the transfer material is stopped by the refeeding device corresponding to length of the inverted transfer material in a feeding direction.

According to this configuration, an inverted transfer material is put on standby at a position corresponding to length of the inverted transfer material in a feeding direction when no image data to be formed on the second side is received. Therefore, it is possible to reduce the part of the sheet exposed outside the apparatus on standby after finishing printing the first side in both-sided printing.

Preferably, the refeeding controlling device stops the transfer material at a predetermined standby position irrespective of the length of the transfer material in the feeding direction in the case where the length of the transfer material in the feeding direction is a predetermined value or less.

More preferably, the refeeding controlling device stops the transfer material at a position further downstream from the predetermined standby position in the case where the length of the transfer material in the feeding direction exceeds the predetermined value.

Further preferably, the refeeding controlling device stops the transfer material at a position further downstream from the predetermined standby position in the case where a part of the transfer material is exposed outside the image forming apparatus when the transfer material is stopped at the predetermined standby position.

Preferably, the refeeding controlling device stops the transfer material at a position where no part of the transfer material is exposed outside the image forming apparatus.

Preferably, the refeeding controlling device stops the transfer material at a position before the paper feeding device.

Preferably, the image forming apparatus further comprises a standby device that puts the transfer material on standby at a position before a junction of a paper path for feeding the fed transfer material and the refeeding path.

To attain the above object, a second aspect of the present invention provides the control method for the image forming apparatus comprising a paper feeding step of feeding a transfer material, a receiving step of receiving image data, an image forming step of forming an image on a first side or a second side of the fed transfer material with an image forming device based on the image data received in the receiving step, an inversion step of feeding the transfer material having the image formed on its first side until a part of the transfer material gets exposed outside the image forming apparatus and then feeding the transfer material to a refeeding path in the image forming apparatus, a refeeding step of feeding the transfer material inverted in the inversion step to a standby position to form the image on the second side of the transfer material and stopping it there, a determining step of determining whether or not a preparation for forming the image on the second side of the transfer material is completed, and a refeeding controlling step of, in the case where the preparation for forming the image on the second side of the transfer material is not completed, changing the standby position for having the transfer material stopped in the refeeding step corresponding to length of the inverted transfer material in a feeding direction.

Preferably, the refeeding controlling step stops the transfer material at a predetermined standby position irrespective of the length of the transfer material in the feeding direction in the case where the length of the transfer material in the feeding direction is a predetermined value or less.

More preferably, the refeeding controlling step stops the transfer material at a position further downstream from the predetermined standby position in the case where the length of the transfer material in the feeding direction exceeds the predetermined value.

Further preferably, the refeeding controlling step stops the transfer material at a position further downstream from the predetermined standby position in the case where a part of the transfer material is exposed outside the image forming apparatus when the transfer material is stopped at the predetermined standby position.

Preferably, the refeeding controlling step stops the transfer material at a position where no part of the transfer material is exposed outside the image forming apparatus.

Preferably, the refeeding controlling step stops the transfer material at a position before a position at which the transfer material is fed in the paper feeding step.

Preferably, the refeeding controlling step stops the transfer material at a position before a junction of a first paper path for feeding the fed transfer material and a second paper path for feeding the inverted transfer material.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing preferred embodiments thereof.

Figure 1:
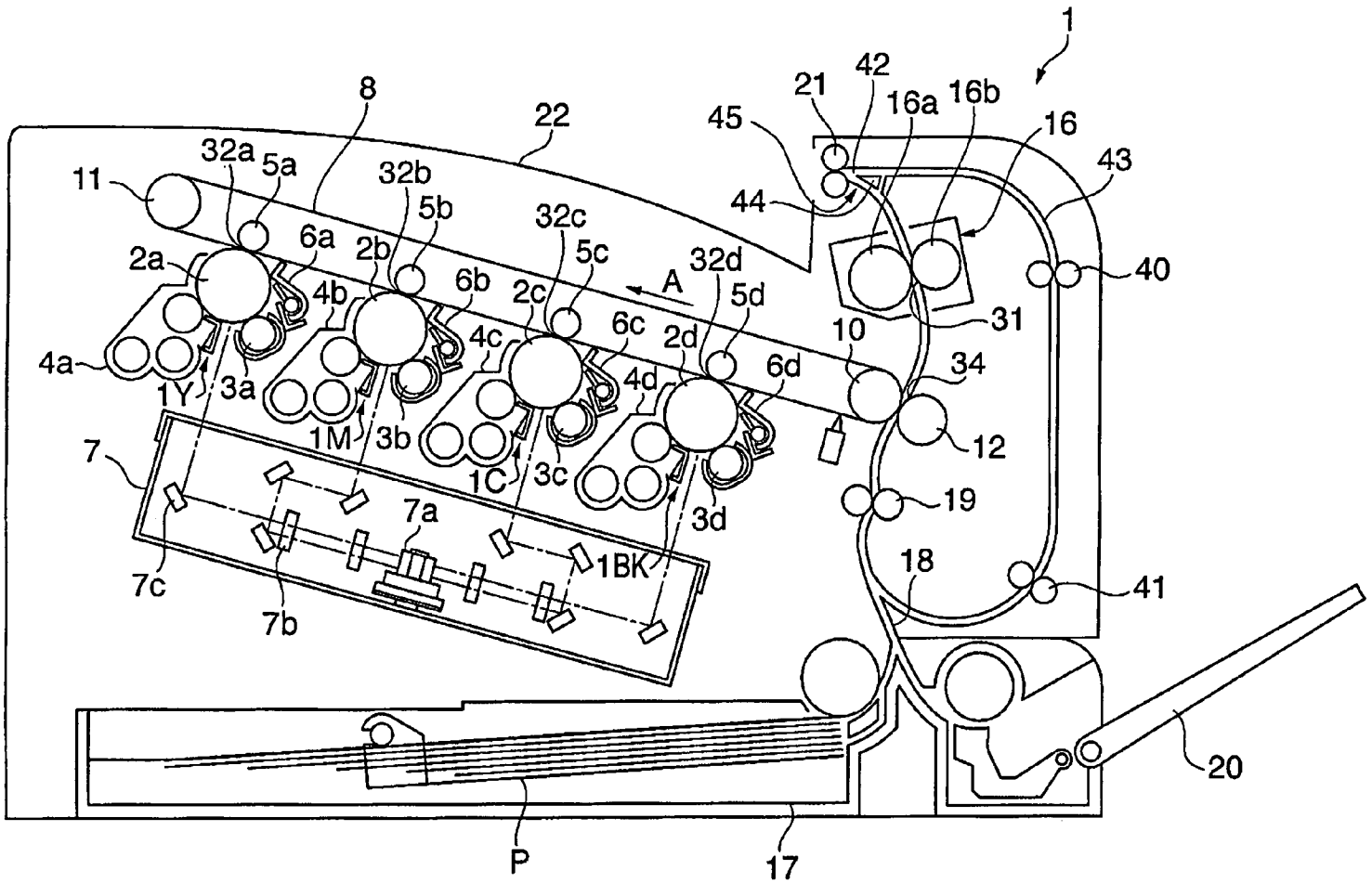
FIG. 1 is a sectional view showing a full-color printer as a form of an image forming apparatus according to an embodiment of the present invention.

FIG. 1 is a sectional view showing a full-color printer as a form of an image forming apparatus according to an embodiment of the present invention.

In FIG. 1, a full-color printer 1 (image forming apparatus) comprises an image forming portion 1Y for forming a yellow-colored image, an image forming portion 1M for forming a magenta-colored image, an image forming portion 1C for forming a cyan-colored image and an image forming portion 1Bk for forming a black-colored image. These four image forming portions 1Y, 1M, 1C and 1Bk are lined up with a certain spacing.

The image forming portions 1Y, 1M, 1C and 1Bk comprise drum-shaped electrophotographic photo conductors as image bearing member (referred to as "photoconductive drums" hereafter) 2*a* to 2*d*, primary chargers 3*a* to 3*d* as primary charging means, development apparatuses 4*a* to 4*d*, transfer rollers 5*a* to 5*d* as primary transfer means and drum cleaner apparatuses 6*a* to 6*d*, respectively.

The full-color printer 1 also comprises a laser exposure apparatus 7 below the image forming portions 1Y, 1M, 1C and 1Bk, and further comprises an endless intermediate transfer belt 8 between the photoconductive drums 2*a* to 2*d* and the transfer rollers 5*a* to 5*d*.

The photoconductive drums 2*a* to 2*d* consist of OPC photo conductors having a property of being negatively charged, and have a photoconductive layer on a drum base made of aluminum. The photoconductive drums 2*a* to 2*d* are rotatively driven by a drive unit (not shown) at a predetermined process speed in a clockwise direction in FIG. 1. The primary chargers 3*a* to 3*d* charge surfaces of the photoconductive drums 2*a* to 2*d* evenly with a charge bias applied from a charge bias power supply (not shown) at a predetermined negative potential respectively.

The development apparatuses 4*a* to 4*d* have a yellow toner, a cyan toner, a magenta toner and a black toner housed therein respectively. The development apparatuses 4*a* to 4*d* attach the toners of their respective colors to electrostatic latent images formed on the photoconductive drums 2*a* to 2*d* so as to develop them as toner images (render them as visible images). The transfer rollers 5*a* to 5*d* are in contact with the photoconductive drums 2*a* to 2*d* in primary transfer portions 32*a* to 32*d* via the intermediate transfer belt 8 respectively. The drum cleaner apparatuses 6*a* to 6*d* include cleaning blades for removing the toners remaining on the photoconductive drums 2*a* to 2*d* after a primary transfer and the like respectively.

The laser exposure apparatus 7 includes a laser light emitting device 7*a*, a polygon lens 7*b*, a reflecting mirror 7*c* and the like. The laser exposure apparatus 7 irradiates the photoconductive drums 2*a* to 2*d* charged by the primary chargers 3*a* to 3*d* with a laser corresponding to image data inputted from an external apparatus respectively. Thus, the electrostatic latent images in the respective colors corresponding to the image data are formed on the photoconductive drums 2*a* to 2*d*. The intermediate transfer belt 8 is configured by a dielectric resin such as a polycarbonate, a polyethylene terephthalate resin film or a polyvinylidene fluoride resin film.

The full-color printer 1 further comprises a secondary transfer opposed roller 10, a tension roller 11 and a secondary transfer roller 12.

The intermediate transfer belt 8 is placed movably to be opposed to top surfaces of the photoconductive drums 2*a* to 2*d*, and is set up between the secondary transfer opposed roller 10 and the tension roller 11. The secondary transfer opposed roller 10 is in contact with the secondary transfer roller 12 in a secondary transfer portion 34 via the intermediate transfer belt 8 to drive the intermediate transfer belt 8 in the direction of an arrow A. The tension roller 11 is placed at a position opposed to the secondary transfer opposed roller 10 across the primary transfer portions 32*a* to 32*d* so as to provide a tension to the intermediate transfer belt 8. The intermediate transfer belt 8 is placed to be inclined at an angle of gradient of 15° with the secondary transfer roller 12 side (that is, the secondary transfer portion 34 side) downward.

The full-color printer 1 further comprises a belt cleaning apparatus (not shown) in proximity to the tension roller 11 outside the intermediate transfer belt 8. This belt cleaning apparatus removes and collects the toners remaining on the intermediate transfer belt 8 after a secondary transfer.

The full-color printer 1 further comprises a paper cassette 17 having a transfer material (paper) P housed therein, a manual feeding tray 20, a paper path 18, a registration roller 19, a fixing apparatus 16, an ejection roller 21, a ejection tray 22, a both-side path 43, both-side rollers 40, 41 and a flapper 44.

The paper cassette 17 and the manual feeding tray 20 feed the transfer material P to the paper path 18. The registration roller 19 feeds the transfer material P to the secondary transfer roller 12 in good timing. The fixing apparatus 16 includes a fixing roller 16*a* and a pressure roller 16*b* which are mutually in contact in a fixing nip portion 31.

The ejection roller 21 ejects the transfer material P to the ejection tray 22 provided on the top surface of-the full-color printer 1. When performing both-sided printing, a trailing edge of the transfer material P reaches an inversion position 42, and then the flapper 44 is switched to the both-side path 43 side and the ejection roller 21 rotates inversely so as to feed the transfer material P to the both-side path 43. The both-side rollers 40, 41 feed the transfer material P within the both-side path 43. The full-color printer 1 has length of the paper path designed to be short for the sake of miniaturizing the apparatus so that a part of the sheet is exposed outside the apparatus on inverting the sheet.

Hereunder, an image forming operation of the full-color printer 1 on single-sided printing will be described.

First, if an image formation start signal is generated from a CPU of the full-color printer 1, the photoconductive drums 2*a* to 2*d* of the image forming portions 1Y, 1M, 1C and 1Bk are rotatively driven at a predetermined process speed respectively. The photoconductive drums 2*a* to 2*d* are negatively charged uniformly by the primary chargers 3*a* to 3*d* respectively.

The laser light emitting device 7*a* emits the laser corresponding to the image data of each of the colors inputted from the external apparatus. The laser emitted from the laser light emitting device 7*a* is radiated on each of the photoconductive drums 2*a* to 2*d* by way of the polygon lens 7*b*, reflecting mirror 7*c* and the like. Thus, the electrostatic latent images corresponding to the image data of the colors are formed on the photoconductive drums 2*a* to 2*d*.

Next, in the image forming portion 1Y, the development apparatus 4*a* has a developing bias of the same polarity as charge polarity (negative polarity) of the photoconductive drum 2*a* applied thereto. The development apparatus 4*a* attaches the toner of yellow to the electrostatic latent image formed on the photoconductive drum 2*a* so as to render it as a visible image. The toner image of yellow on the photoconductive drum 2*a* is primarily transferred on the intermediate transfer belt 8 driven in the direction of an arrow A by the transfer roller 5*a* having a primary transfer bias of the polarity (positive polarity) reverse to the toner applied thereto in the primary transfer portion 32*a*. The toner remaining on the photoconductive drum 2*a* after the primary transfer on the intermediate transfer belt 8 is scraped off by the cleaning blade provided to the drum cleaner apparatus 6*a* or the like so as to be collected.

Next, the toner image of yellow transferred on the intermediate transfer belt 8 is moved to the image forming portion 1M side. In the image forming portion 1M, the toner image of magenta formed on the photoconductive drum 2*b* is transferred to be superimposed on the toner image of yellow transferred on the intermediate transfer belt 8 as with the image forming portion 1Y.

Hereunder, in the image forming portions 1C and 1Bk, the toner images of cyan and black formed on the photoconductive drums 2*c* and 2*d* are transferred likewise to be superimposed in series on the toner images of yellow and magenta transferred on the intermediate transfer belt 8. Thus, full-color toner images are transferred on the intermediate transfer belt 8.

Next, the registration roller 19 feeds the transfer material P fed from the paper cassette 17 or the manual feeding tray 20 to the secondary transfer portion 34 in right timing for having a leading edge of the full-color toner image transferred on the intermediate transfer belt 8 moved to the secondary transfer portion 34. The secondary transfer roller 12 having a secondary transfer bias of the polarity (positive polarity) reverse to the toner applied thereto secondarily transfers onto the transfer material P the full-color toner image primarily transferred on the intermediate transfer belt 8 in the secondary transfer portion 34. The toner and the like remaining on the intermediate transfer belt 8 after the secondary transfer are removed by a belt cleaning apparatus not shown so as to be collected.

Next, the transfer material P having the full-color toner image secondarily transferred thereon is fed to the fixing nip portion 31. In the fixing nip portion 31, the fixing roller 16*a* and the pressure roller 16*b* heat and pressurize the transfer material P having the full-color toner image secondarily transferred thereon to heat-fix the toner image on the transfer material P. The ejection roller 21 ejects the transfer material P having the toner image heat-fixed thereon onto the ejection tray 22 so as to finish a series of steps of the image forming operation.

Hereunder, the image forming operation of the full-color printer 1 on the both-sided printing will be described.

The image forming operation on the both-sided printing is the same as the image forming operation on the single-sided printing as to the steps until having the toner image heat-fixed on the first side of the transfer material P by the fixing roller 16*a* and the pressure roller 16*b*.

The ejection roller 21 rotates forward and thereby feeds the transfer material P having the toner image heat-fixed on the first side thereof in the direction toward the ejection tray 22, and stops the feeding when the trailing edge of the transfer material P arrives at the inversion position 42. Arrival of the transfer material at the inversion position 42 is determined by a sensor 45.

Next, the flapper 44 is switched to the both-side path 43 side and the ejection roller 21 rotates inversely so as to feed the transfer material P to the both-side path 43. The both-side rollers 40, 41 feed the transfer material P in the direction toward the registration roller 19 within the both-side path 43. Thus, the transfer material P is fed to the secondary transfer portion 34 in an inverted state.

Meanwhile, the image formation start signal corresponding to the second side of the transfer material P from the CPU of the full-color printer 1 is generated, and the toner images of the respective colors are primarily transferred in series onto the intermediate transfer belt 8. The registration roller 19 feeds the inverted transfer material P to the secondary transfer portion 34 in right timing for having the leading edge of the full-color toner image on the intermediate transfer belt 8 moved to the secondary transfer portion 34.

Next, as in the case of the single-sided printing, the toner image primarily transferred onto the intermediate transfer belt 8 is secondarily transferred onto the transfer material P by the secondary transfer portion 34. The toner image is heat-fixed on the transfer material P by the fixing nip portion 31, and the transfer material P having the toner image heat-fixed thereon is ejected onto the ejection tray 22 so as to finish the series of steps of the image forming operation.

Figure 2:
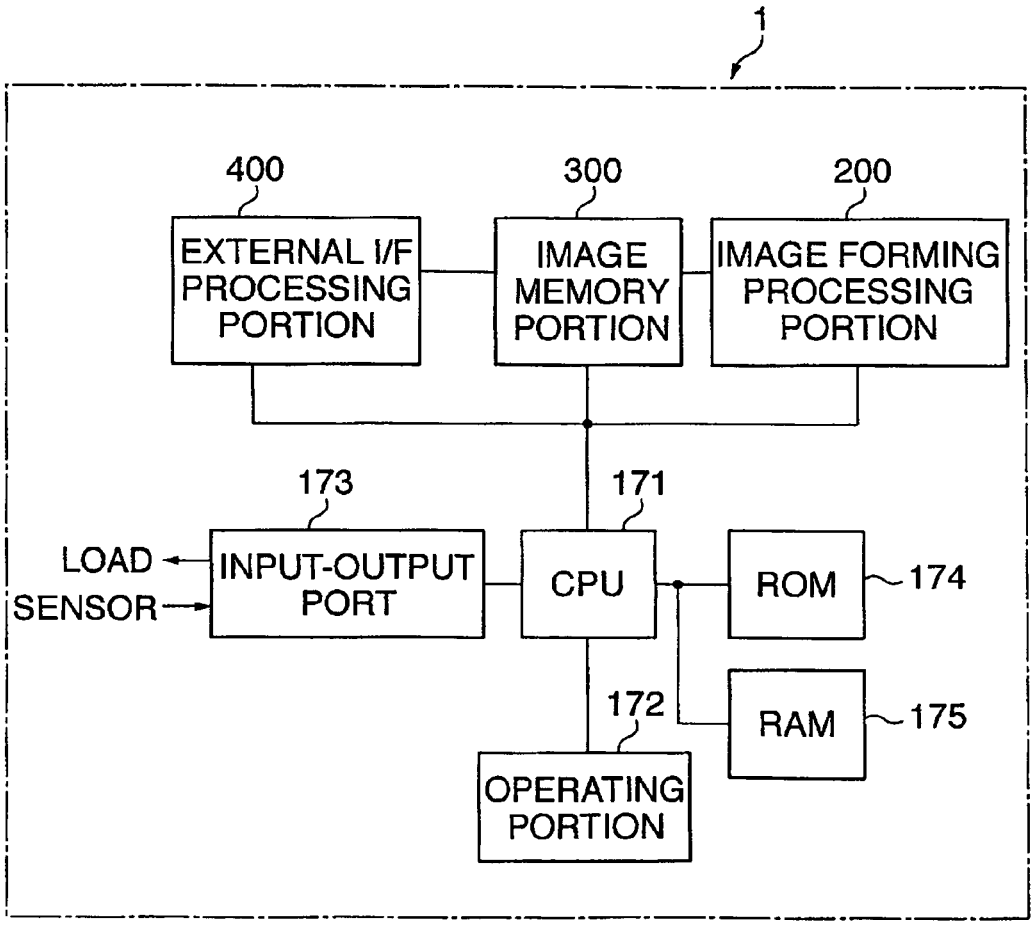
FIG. 2 is a block diagram showing an internal configuration of the full-color printer of FIG. 1.

FIG. 2 is a block diagram showing an internal configuration of the full-color printer 1 of FIG. 1.

In FIG. 2, the full-color printer 1 comprises a CPU 171. The full-color printer 1 also comprises an ROM 174, an RAM 175, an input-output port 173, an operating portion 172, an image forming processing portion 200, an image memory portion 300 and an external I/F (interface) processing portion 400, and they are connected to the CPU 171 via an address bus and a data bus respectively.

The CPU 171 controls the full-color printer 1. The ROM 174 has a control program to be executed by the CPU 171 stored therein. The RAM 175 is a work area where the CPU 171 performs processing.

The input-output port 173 has a sensor for detecting load of a motor, a clutch and the like for controlling the operation of the full-color printer 1, and a position of the sheet, and the like connected thereto. The CPU 171 controls input and output of the signals via the input-output port 173 and performs the image forming operation according to the control program stored in the ROM 174.

The operating portion 172 includes a display device and a key input device. An operator uses the key input device to instruct the CPU 171 to switch an image forming operation mode and a display. The CPU 171 displays the state of the full-color printer 1 and a setup of the operation mode by key input on the display device.

The external I/F processing portion 400 and the image forming processing portion 200 are connected to the image memory portion 300 respectively. The external I/F processing portion 400 transmits and receives the image data, processing data and the like to and from an external apparatus such as a PC (Personal Computer). The image memory portion 300 performs an expansion process and temporary accumulation of the image data, and the like. The image forming processing portion 200 performs a process for causing the laser exposure apparatus 7 to emit the laser corresponding to line image data transferred from the image memory portion 300.

Figure 3:
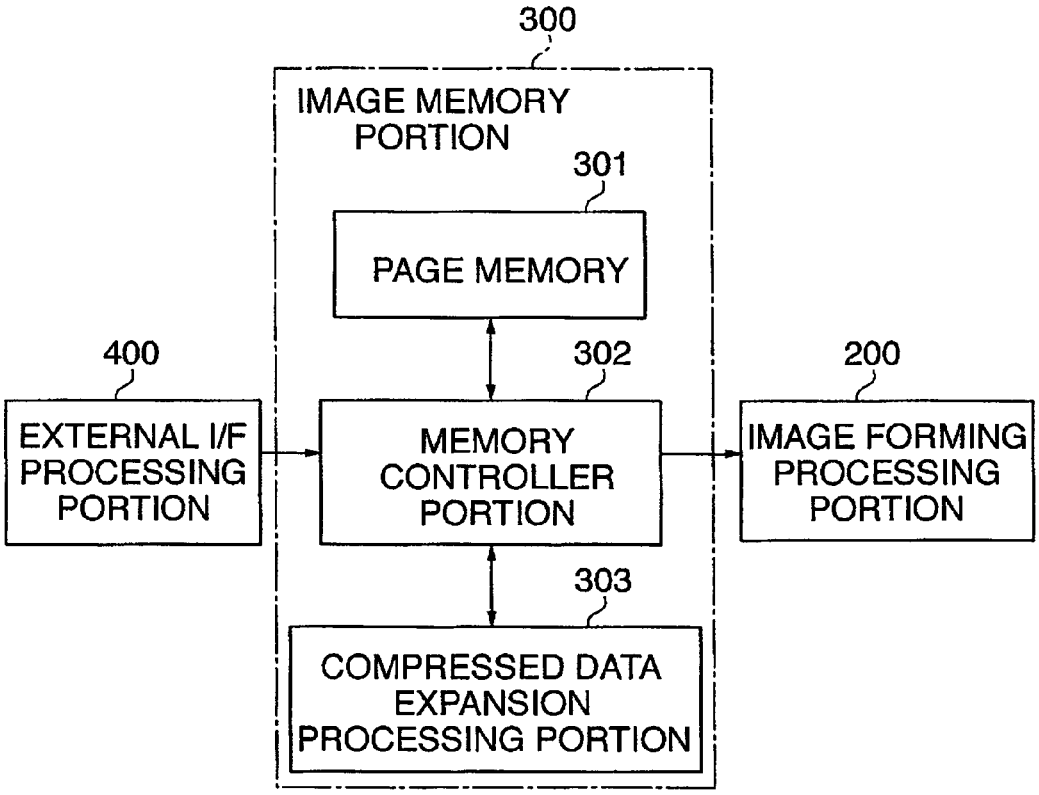
FIG. 3 is a block diagram showing the configuration of an image memory portion of FIG. 2 in detail.

FIG. 3 is a block diagram showing the configuration of the image memory portion 300 of FIG. 2 in detail.

In FIG. 3, the image memory portion 300 comprises a memory controller portion 302 connected to the external I/F processing portion 400 and the image forming processing portion 200 respectively, and a page memory 301 and a compressed data expansion processing portion 303 connected to the memory controller portion 302.

The page memory 301 is configured by a memory such as a DRAM. The memory controller portion 302 writes to the page memory 301 the image data received from the external apparatus via the external I/F processing portion 400. The memory controller portion 302 also reads out the image data written to the page memory 301 to the image forming processing portion 200.

Furthermore, the memory controller portion 302 determines whether or not the image data received from the external apparatus via the external I/F processing portion 400 is compressed data. When the image data received from the external apparatus is the compressed data, the compressed data expansion processing portion 303 performs the expansion process of the image data, and the memory controller portion 302 writes the expanded image data to the page memory 301.

In addition, the memory controller portion 302 generates a DRAM refresh signal of the page memory 301, interferes in access to the page memory 301 when writing from the external I/F processing portion 400 and reading out to the image forming processing portion 200, and controls a write address to the page memory 301, a readout address and a read direction from the page memory 301 and the like.

Figure 4:
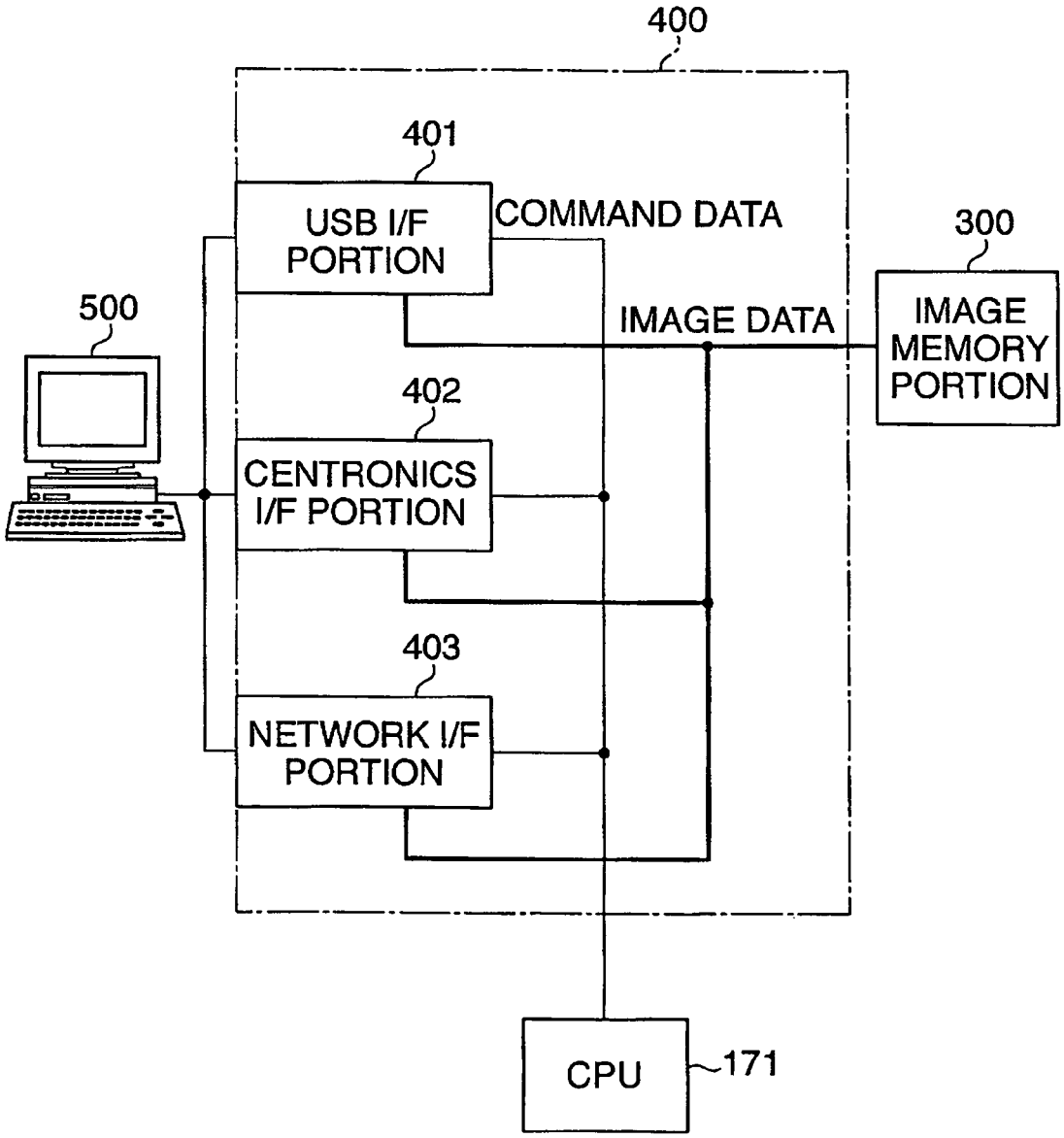
FIG. 4 is a block diagram showing the configuration of an external I/F processing portion of FIG. 2 in detail.

FIG. 4 is a block diagram showing the configuration of the external I/F processing portion 400 of FIG. 2 in detail.

In FIG. 4, the external I/F processing portion 400 comprises a USB I/F portion 401, a Centronics I/F portion 402 and a network I/F portion 403, and they are connected to an external apparatus 500, the CPU 171 and the image memory portion 300 respectively. The external apparatus 500 is a computer, a work station or the like.

The external I/F processing portion 400 receives the image data and command data transmitted from the external apparatus 500 via one of the USB I/F portion 401, Centronics I/F portion 402 and network I/F portion 403.

The command data received from the external apparatus 500 is processed by the CPU 171. The CPU 171 performs the setup for executing a print operation and generation of the timing by using the image forming processing portion 200, the input-output port 173 and the like based on the command data.

The image data received from the external apparatus 500 is transmitted to the image memory portion 300 according to the timing based on the command data. The image forming processing portion 200 performs the process for forming images based on the image data.

The external I/F processing portion 400 transmits state information and the like of the full-color printer 1 determined by the CPU 171 to the external apparatus 500 via one of the USB I/F portion 401, Centronics I/F portion 402 and network I/F portion 403.

Hereunder, a description will be given as to a standby position of the transfer material P in both-sided printing on the full-color printer 1 of FIG. 1.

A both-sided print job is started in a stage of having the image data and command data on the image on the first side received from the external apparatus 500 by the external I/F processing portion 400. And the aforementioned image formation on the first side is started, the transfer material P is fed from the paper cassette 17 or the manual feeding tray 20 to the secondary transfer portion 34, and the toner image is transferred.

While the image formation on the first side of the transfer material P is finished and the transfer material P passes through the both-side path 43, the external I/F processing portion 400 receives the image data and command data on the image on the second side from the external apparatus 500 so that the full-color printer 1 starts preparation for the image formation on the second side.

In the case of an ordinary both-sided print job, the time necessary for the processes such as rasterizing and compressing the image data on the image on the second side is shorter than the time until a predetermined step of the image formation on the first side is finished. In this case, when the image formation on the first side is finished, the transfer material P is fed to the secondary transfer portion 34 without being put on standby on the both-side path 43 so as to perform the image formation on the second side.

There are the cases where the processes of rasterizing and compressing the image data on the image on the second side take longer time than usual depending on the property of the image data. In this case, the external I/F processing portion 400 cannot receive the image data and command data on the image on the second side from the external apparatus 500 before the transfer material P passes through the both-side path 43. Therefore, the image formation on the second side cannot be performed immediately after finishing the image formation on the first side, and so the transfer material P must be put on standby at a predetermined standby position on the both-side path 43. When the external I/F processing portion 400 receives the image data and command data on the image on the second side from the external apparatus 500, feeding of the transfer material P having been put on standby at the standby position is restarted so as to perform the image formation on the second side.

The standby position is constantly set at the same position so that image formation timing will be the same on restarting the feeding of the transfer material P irrespective of the size of the transfer material P. To be more specific, it is set so that a leading edge location of the transfer material P on restarting the feeding in the feeding direction will be the same irrespective of the size of the transfer material P. Therefore, the trailing edge location of the transfer material P is different according to the size.

FIGS. 5A to 5E are diagrams for describing the standby position of the transfer material P in both-sided printing on the full-color printer of FIG. 1.

FIGS. 5A to 5E show a standby state of the transfer material P when the image formation on the second side cannot be performed immediately after finishing the image formation on the first side.

Figure 5A:
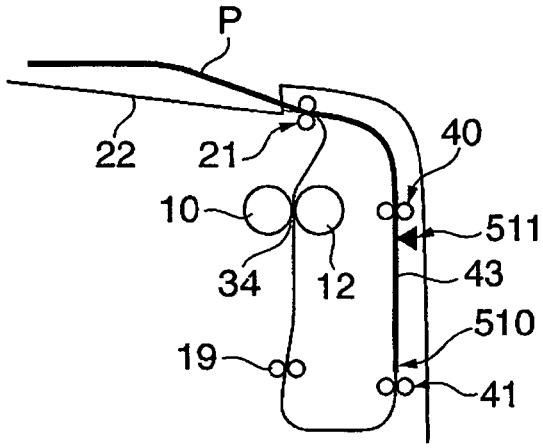
FIGS. 5A to 5E are diagrams for describing a standby position of a transfer material in both-sided printing on the full-color printer of FIG. 1.

FIG. 5A is a diagram showing a state in which the transfer material P in A3 size, for instance, is on standby at the predetermined standby position on the both-side path 43.

In FIG. 5A, a standby position 510 is provided on an upstream side of the both-side roller 41 on the both-side path 43. A both-side sensor 511 for detecting whether or not there is the transfer material P is further provided on the both-side path 43.

The leading edge (in the feeding direction on restarting the feeding) of the inverted transfer material P is on standby at the standby position 510. The length of the transfer material P in the feeding direction is longer than the length from the standby position 510 to the ejection roller 21 (the length by way of the both-side path 43, same hereunder) so that the trailing edge of the transfer material P is exposed outside the apparatus.

Figure 5B:
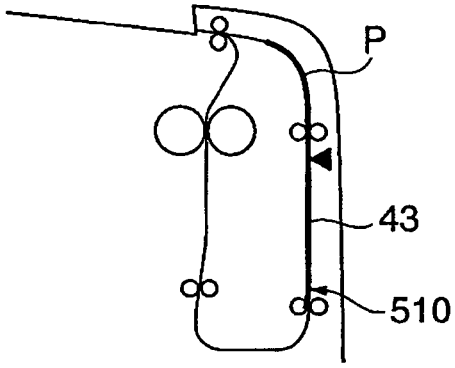

FIG. 5B is a diagram showing a state in which the transfer material P in A4 size, for instance, is on standby at the standby position 510 on the both-side path 43.

In FIG. 5B, the length of the transfer material P in the feeding direction is shorter than the length from the standby position 510 to the ejection roller 21 so that the entire transfer material P is inside the apparatus. In this case, there is no possibility that the user mistakenly pulls the transfer material P on standby out of the apparatus.

Figure 5D:
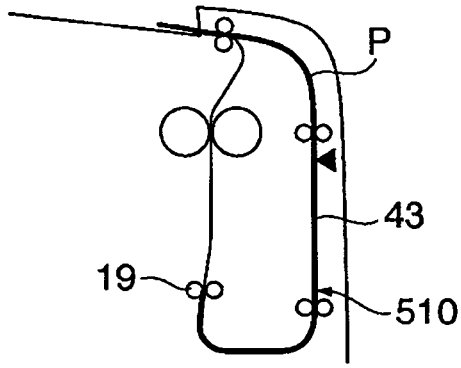
Figure 5C:
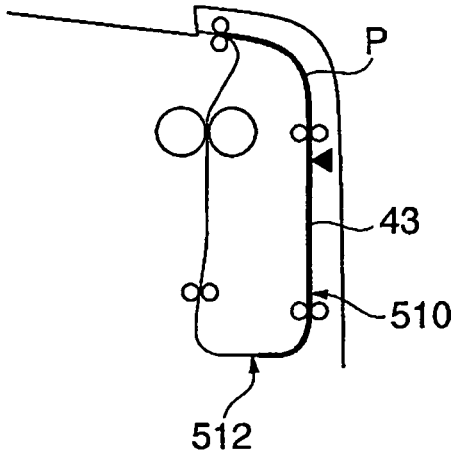

FIG. 5C is a diagram showing a state in which the transfer material P in A4R size, for instance, is on standby at another standby position 512 on the both-side path 43.

In FIG. 5C, the length of the transfer material P in the feeding direction is longer than the length from the standby position 510 to the ejection roller 21. If the transfer material P is put on standby at the standby position 510, the trailing edge of the transfer material P is exposed outside the apparatus.

Thus, as shown in FIG. 5C, the transfer material P is put on standby at the other standby position 512 further downstream than the standby position 510 by a difference in length between the length of the transfer material P in the feeding direction and the length from the standby position 510 to the ejection roller 21. To be more specific, the position at which the leading edge of the transfer material P is on standby is different according to the length of the transfer material P in the feeding direction. It is thereby possible to prevent the trailing edge of the transfer material P from being exposed outside the apparatus.

FIG. 5D is a diagram showing a state in which the transfer material P in A3 size, for instance, is on standby at the position before the registration roller 19 on the both-side path 43.

In FIG. 5D, the length of the transfer material P in the feeding direction is longer than the length from the standby position 510 to the ejection roller 21.

The registration roller 19 feeds the transfer material P so that the leading edge of the transfer material P arrives at the secondary transfer portion 34 in right timing for having the leading edge of the toner image on the intermediate transfer belt 8 arriving at the secondary transfer portion 34. For that reason, if the transfer material P is put on standby further downstream than the registration roller 19, the image on the second side cannot be formed at a correct position.

Thus, as shown in FIG. 5D, the transfer material P is put on standby at the position before the registration roller 19 so as to form the image on the second side at the correct position and reduce the part of the transfer material P exposed outside the apparatus.

Figure 5E:
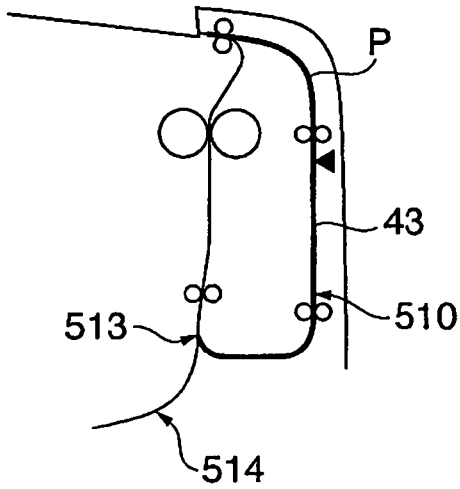

FIG. 5E is a diagram showing a state in which the transfer material P in B4 size, for instance, is on standby at the position before a junction 513 on the both-side path 43.

In FIG. 5E, the length of the transfer material P in the feeding direction is longer than the length from the standby position 510 to the ejection roller 21.

There are the cases where, in the state of having the transfer material P on standby at the standby position, the external I/F processing portion 400 receives the data on the image on the first side of a next transfer material P' before the data on the image on the second side of the transfer material P. In this case, the next transfer material P' is fed from the paper cassette 17 or the manual feeding tray 20 via a paper path 514. For that reason, if the transfer material P is put on standby further downstream than the junction 513 of the both-side path 43 and the paper path 514, the next transfer material P' cannot be fed from the paper cassette 17 or the manual feeding tray 20.

Thus, as shown in FIG. 5E, the transfer material P is put on standby at the position before the junction 513 to be able to feed the next transfer material P' from the paper cassette 17 or the manual feeding tray 20 and reduce the part of the transfer material P exposed outside the apparatus.

Figure 6A:
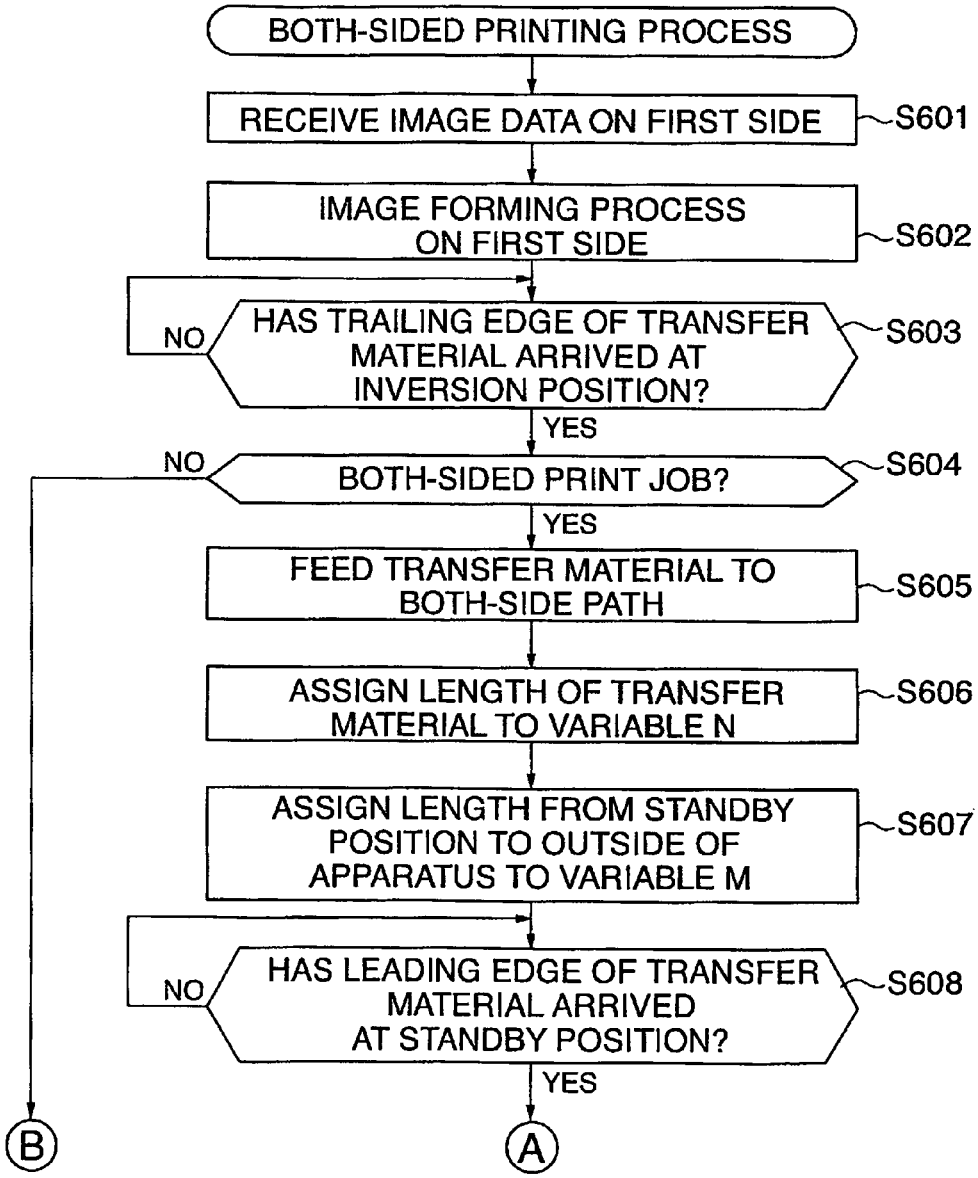
FIGS. 6A and 6B are flowcharts showing a flow of a both-sided printing process performed by a CPU of FIG. 2.
Figure 6B:
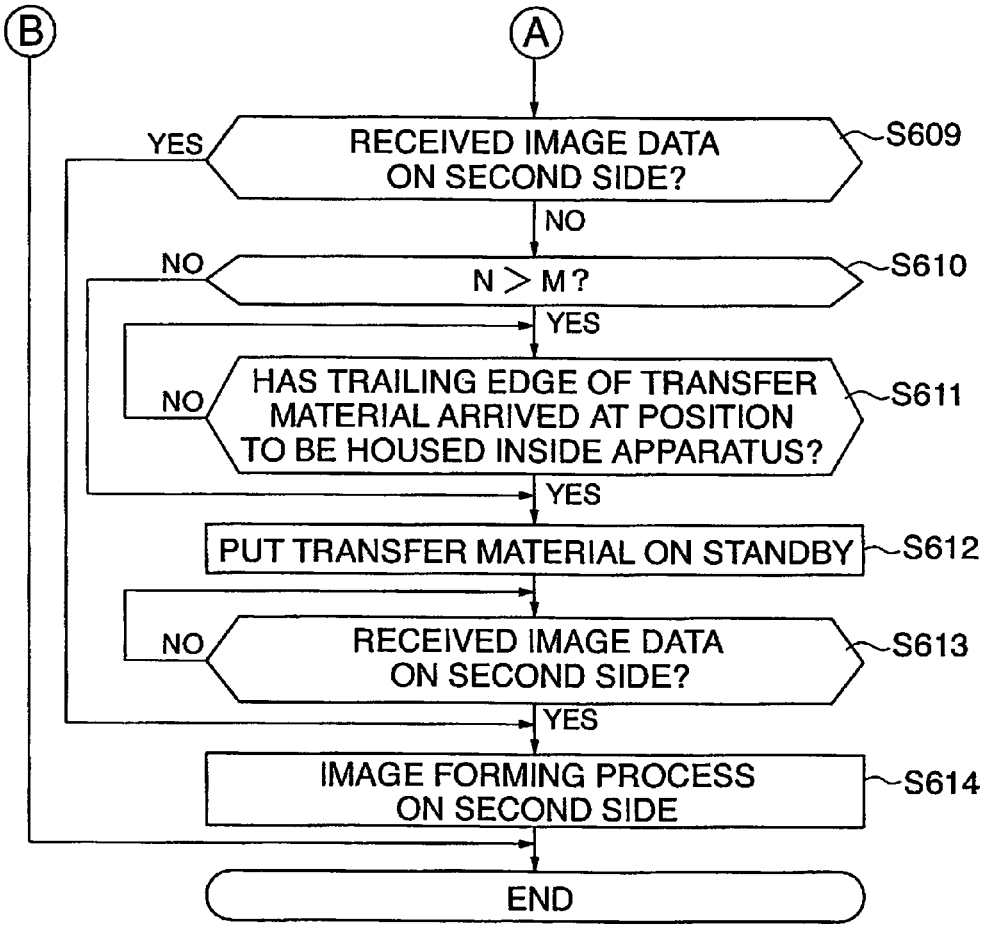

FIGS. 6A and 6B are flowcharts showing a flow of a both-sided printing process performed by the CPU 171 of FIG. 2.

This process assumes that the length of the transfer material P is shorter than the length from the position before the registration roller 19 to the ejection roller 21.

As for the description of this process, no consideration is given, for convenience sake, to the cases where the feeding of the transfer material P is stopped halfway for a reason such as a jam of the transfer material P, the print job is cancelled or the like.

In FIGS. 6A and 6B, the CPU 171 receives the image data and command data on the image on the first side of the print job from the external apparatus 500 via the external I/F processing portion 400 (step S601).

Next, the CPU 171 causes the image forming processing portion 200 to perform an image forming process on the first side so as to form an image on the first side of the transfer material P (step S602). The transfer material P having the image on the first side thereof formed in the step S602 is fed to the secondary transfer portion 34 and the fixing apparatus 16 in turn. On detecting that the trailing edge of the transfer material P has arrived at the inversion position 42 based on output of the sensor 45 (step S603), the CPU 171 determines whether or not the print job is the both-sided print job (step S604). The determination process of the step S603 may be performed after the step S604.

When the print job is not the both-sided print job, that is, when the print job is determined to be the single-sided print job as a result of the determination of step S604, the CPU 171 finishes this process by waiting until the transfer material P is ejected onto the ejection tray 22 by the ejection roller 21.

When the print job is determined to be the both-sided print job as a result of the determination of step S604, the CPU 171 stops the ejection roller 21, and then switches the flapper 44 to the both-side path 43 side and rotates the ejection roller 21 inversely so as to feed the transfer material P to the both-side path 43 (step S605).

Next, the CPU 171 assigns the length of the transfer material P to a variable N (step S606), and assigns the length from the predetermined standby position 510 to the ejection roller 21 to a variable M (step S607). The length of the transfer material P is determined by measuring it with an unshown sensor provided upstream of the registration roller 19 or determined by setting it from the operating portion 172. And the CPU 171 determines whether or not the leading edge of the transfer material P has arrived at the standby position 510 (step S608). If determined that the leading edge of the transfer material P has arrived at the standby position 510, the CPU 171 determines whether or not the image data and command data on the image on the second side of the transfer material P have already been received from the external apparatus 500 by the external I/F processing portion 400 (step S609). It is determined that the leading edge of the transfer material P has arrived at the standby position by feeding time from detecting the leading edge of the transfer material P with the both-side sensor 511.

If the image data and command data on the image on the second side of the transfer material P are not yet to be received from the external apparatus 500 by the external I/F processing portion 400 as a result of the determination of step S609, the CPU 171 determines whether or not the value of the variable N (length of the transfer material P) is larger than the value of the variable M (length from the standby position 510 to the ejection roller 21) (N>M) (step S610).

If the CPU 171 determines that the value of the variable N is larger than the value of the variable M as a result of the determination of step S610, the length of the transfer material P is longer than the length from the standby position 510 to the ejection roller 21. Therefore, if the CPU 171 puts the transfer material P on standby at the standby position 510, the trailing edge of the transfer material P is exposed outside the apparatus as shown in FIG. 5A. For that reason, the CPU 171 further feeds the transfer material P with the both-side rollers 40, 41 and determines whether or not the trailing edge of the transfer material P has arrived at the position to be housed inside the apparatus as shown in FIG. 5C (step S611). If determined that the trailing edge of the transfer material P has arrived at the position to be housed inside the apparatus, the CPU 171 stops the feeding of the transfer material P and puts the transfer material P on standby (step S612). It is determined that the trailing edge of the transfer material P has arrived at the position to be housed inside the apparatus by the length of the transfer material P and the feeding time from detecting the leading edge of the transfer material P with the both-side sensor 511.

Next, if the image data and command data on the image on the second side of the transfer material P are received from the external apparatus 500 by the external I/F processing portion 400 (YES in a step S613), the CPU 171 feeds the transfer material P to the secondary transfer portion 34 and performs the image forming process on the second side so as to form an image on the second side of the transfer material P (step S614), and the CPU 171 finishes this process by waiting until the transfer material P is ejected on the ejection tray 22 by the ejection roller 21.

If the image data and command data on the image on the second side of the transfer material P have already been received from the external apparatus 500 by the external I/F processing portion 400 as a result of the determination of step S609, the image forming process on the second side can be immediately started. Therefore, the processing from the step S614 onward is performed so as to finish this process.

If the CPU 171 determines that the value of the variable N is smaller than the value of the variable M as a result of the determination of step S610 (NO in the step S610), the length of the transfer material P is shorter than the length from the standby position 510 to the ejection roller 21. Therefore, even if the CPU 171 puts the transfer material P on standby at the standby position 510, the trailing edge of the transfer material P is not exposed outside the apparatus as shown in FIG. 5B. Therefore, the processing from the step S614 onward is performed so as to finish this process.

If determined that the value of the variable N is larger than the value of the variable M (YES in the step S610), the CPU 171 further feeds the transfer material P with the both-side rollers 40, 41, stops the feeding of the transfer material P at the position to have the trailing edge of the transfer material P housed inside the apparatus and puts the transfer material P on standby (steps S611, S612). Therefore, it is possible to prevent the trailing edge of the transfer material P from being exposed outside the apparatus.

In the step S610, it is determined whether or not the length of the transfer material P is longer than the length from the standby position 510 to the ejection roller 21. It is also possible, however, to determine whether or not the length of the transfer material P is a predetermined value or larger.

Figure 7A:
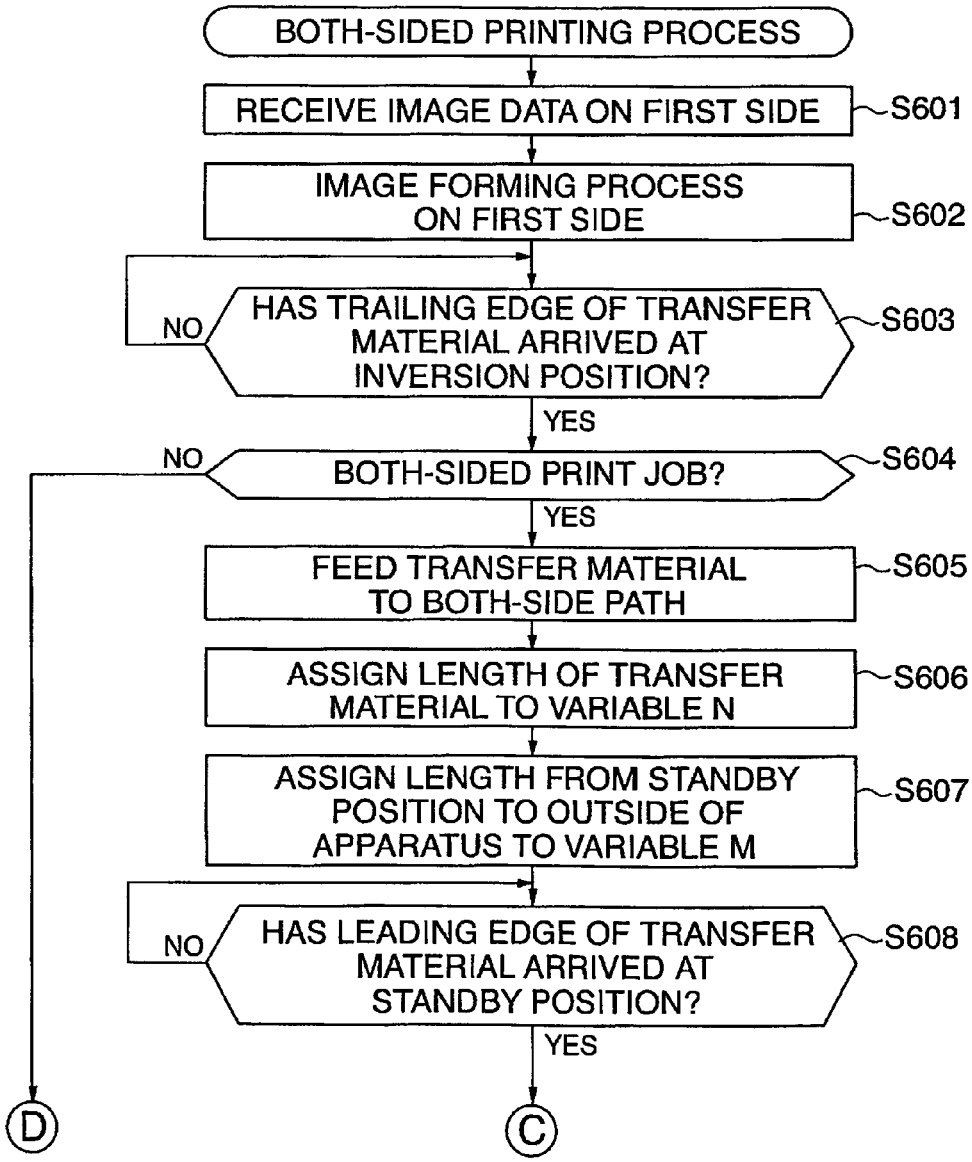
FIGS. 7A and 7B are flowcharts showing a flow of a first variation of the both-sided printing process of FIGS. 6A and 6B and FIGS. 8A and 8B are flowcharts showing the flow of a second variation of the both-sided printing process of FIGS. 6A and 6B.
Figure 7B:
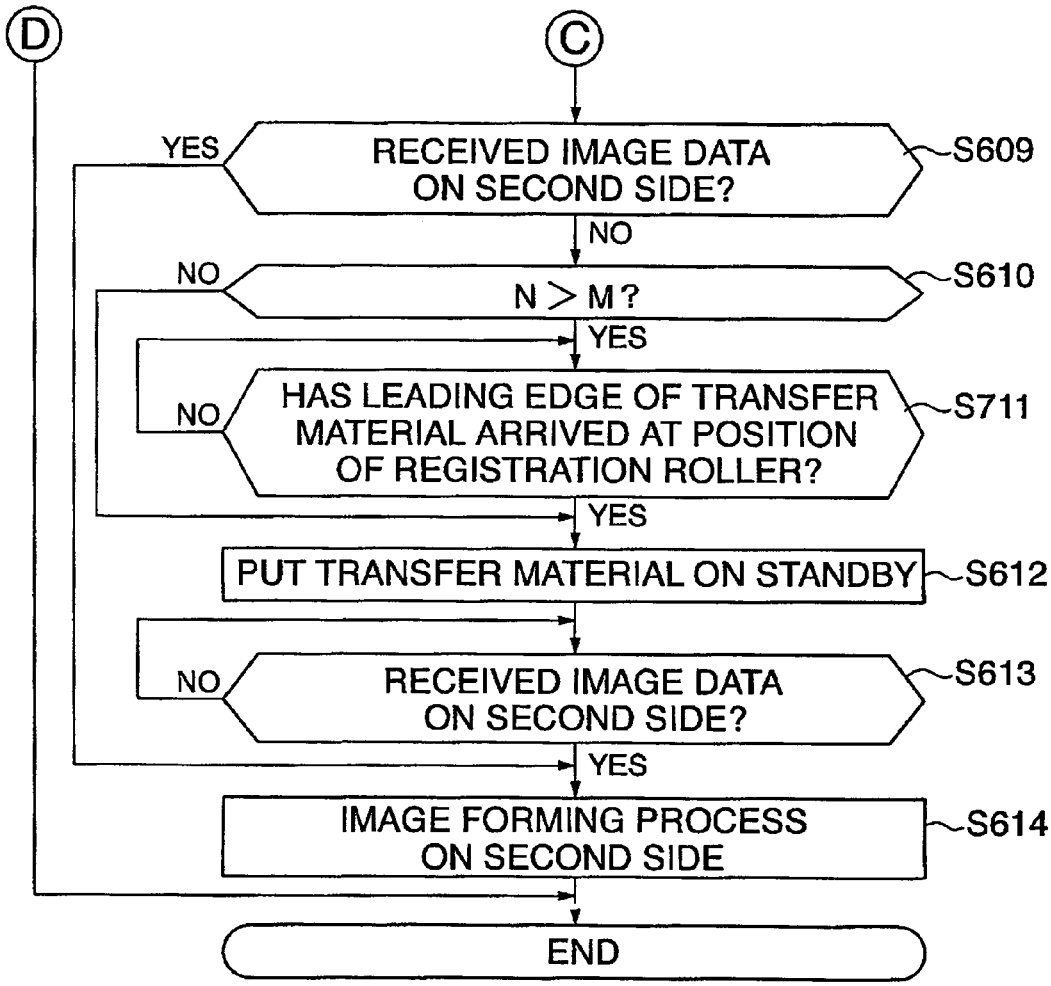

FIGS. 7A and 7B are flowcharts showing the flow of a first variation of the both-sided printing process of FIGS. 6A and 6B.

The process of FIGS. 7A and 7B is only different from the process of FIGS. 6A and 6B in that a step S711 is performed instead of the step S611. In FIGS. 7A and 7B, the same steps as those of FIGS. 6A and 6B are given the same symbols and a description thereof will be omitted.

If the value of the variable N is larger than the value of the variable M (YES in the step S610) in FIG. 7B, the length of the transfer material P is longer than the length from the standby position 510 to the ejection roller 21. Therefore, if the transfer material P is put on standby at the standby position 510, the trailing edge of the transfer material P is exposed outside the apparatus as shown in FIG. 5A. For that reason, the transfer material P is further fed by the both-side rollers 40, 41. The CPU 171 determines whether or not the leading edge of the transfer material P has arrived at the position before the registration roller 19 as shown in FIG. 5D (step S711). If determined that the leading edge of the transfer material P has arrived at the position before the registration roller 19, the CPU 171 stops the feeding of the transfer material P and puts the transfer material P on standby (step S612) to perform the processing from the step S613 onward. It is determined that the leading edge of the transfer material P has arrived at the position before the registration roller 19 by the feeding time from detecting the leading edge of the transfer material P with the both-side sensor 511.

According to the processing of FIGS. 7A and 7B, if the value of the variable N is larger than the value of the variable M (YES in the step S610), the transfer material P is further fed by the both-side rollers 40, 41 and the feeding of the transfer material P is stopped at the position before the registration roller 19 to put the transfer material P on standby (steps S711, S612). Therefore, it is possible to adjust exactly the timing for feeding the transfer material P to a proper timing so as to form the image on the second side at the correct position and reduce the part of the transfer material P exposed outside the apparatus.

When the trailing edge of the transfer material P is housed inside the apparatus before the leading edge of the transfer material P arrives at the position before the registration roller 19 in the processing of FIGS. 7A and 7B, the transfer material P may be put on standby at the position for having its trailing edge housed inside the apparatus.

Figure 8A:
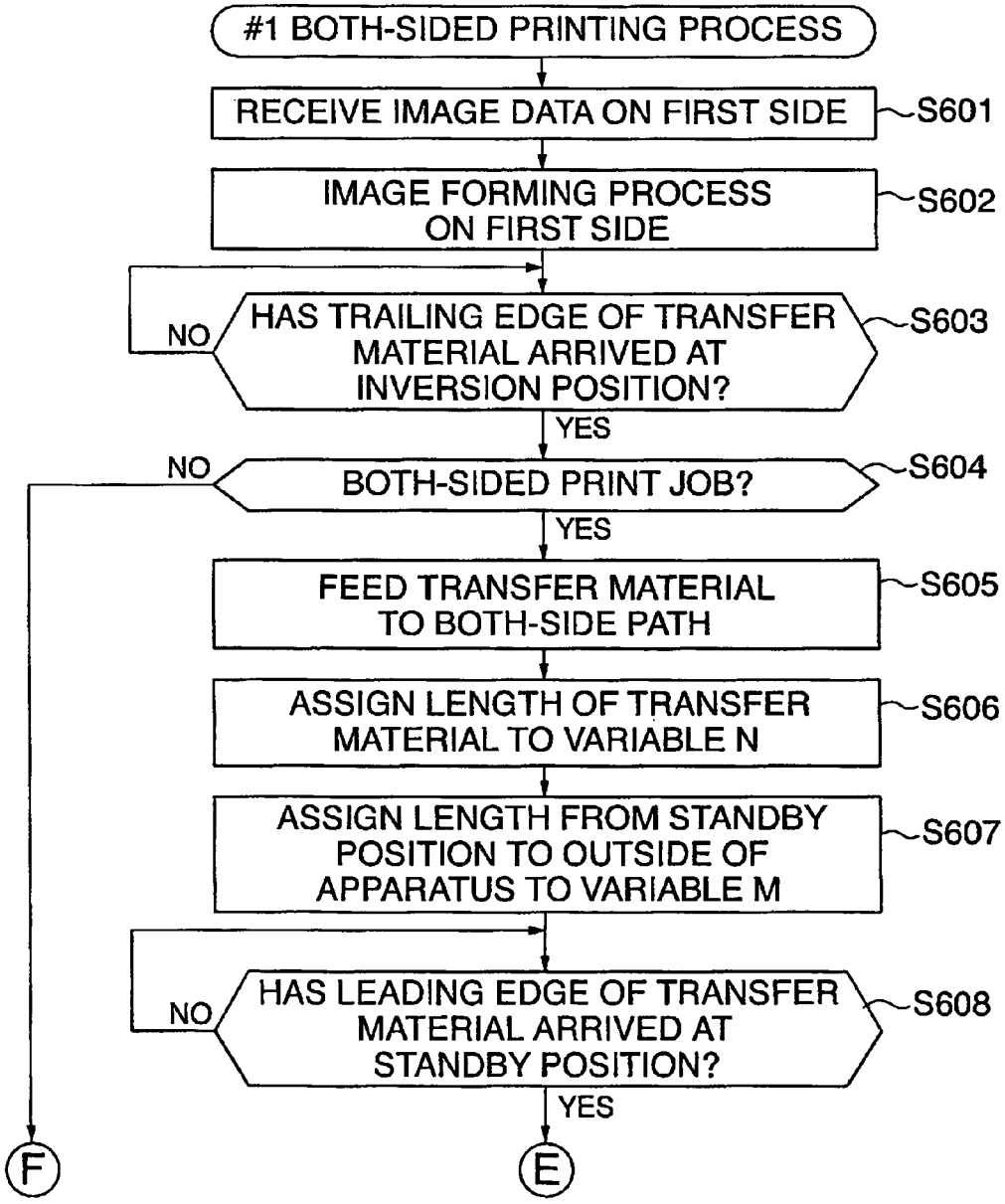
Figure 8B:
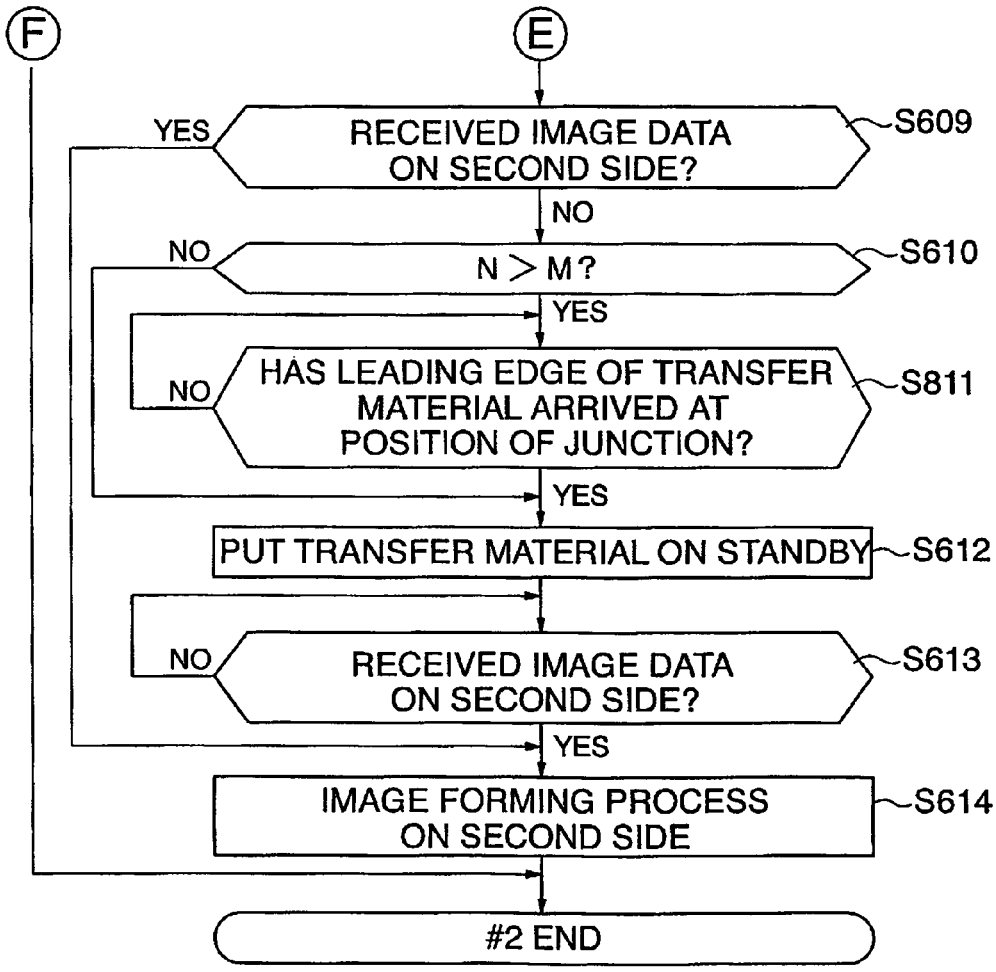

FIGS. 8A and 8B are flowcharts showing the flow of a second variation of the both-sided printing process of FIGS. 6A and 6B.

The processing of FIGS. 8A and 8B is only different from the processing of FIGS. 6A and 6B in that a step S811 is performed instead of the step S611. In FIGS. 8A and 8B, the same steps as those of FIGS. 6A and 6B are given the same symbols and a description thereof will be omitted.

If the value of the variable N is larger than the value of the variable M (YES in the step S610) in FIG. 8B, the length of the transfer material P is longer than the length from the standby position 510 to the ejection roller 21. Therefore, if the transfer material P is put on standby at the standby position 510, the trailing edge of the transfer material P is exposed outside the apparatus as shown in FIG. 5A. For that reason, the transfer material P is further fed by the both-side rollers 40, 41, and it is determined whether or not the leading edge of the transfer material P has arrived at the position before the junction 513 of the both-side path 43 and the paper path 514 as shown in FIG. 5E (step S811). If determined that the leading edge of the transfer material P has arrived at the position before the junction 513, the CPU 171 stops the feeding of the transfer material P and puts the transfer material P on standby (step S612) to perform the processing from the step S613 onward. It is determined that the leading edge of the transfer material P has arrived at the junction 513 by the feeding time from detecting the leading edge of the transfer material P with the both-side sensor 511.

According to the processing of FIGS. 8A and 8B, if the value of the variable N is larger than the value of the variable M (YES in the step S610), the transfer material P is further fed by the both-side rollers 40, 41, and is put on standby at the position before the junction 513 (steps S811, S612). Therefore, it is possible to feed the next transfer material P' from the paper cassette 17 or the manual feeding tray 20 and reduce the part of the transfer material P exposed outside the apparatus.

When the trailing edge of the transfer material P is housed inside the apparatus before the leading edge of the transfer material P arrives at the position before the junction 513 in the processing of FIGS. 8A and 8B, the transfer material P may be put on standby at the position for having its trailing edge housed inside the apparatus.

The image forming apparatus according to the embodiment of the present invention was described by exemplifying the full-color printer. However, the present invention is not limited thereto but is applicable to the apparatuses for forming the images on both sides of the transfer material, such as a black and white printer and a copying machine.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and the storage medium on which the program code is stored constitute the present invention.

Examples of the storage medium for supplying the program code include a floppy (registered trademark) disk, a hard disk, a magneto-optical disk, a CD-ROM, a CD-R, a CD-RW, a DVD-ROM, a DVD-RAM, a DVD–RW, a DVD+RW, a magnetic tape, a nonvolatile memory card, and a ROM. Further, the program code may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing the program code read out from the storage medium into a memory provided in an expansion board inserted into a computer or in an expansion unit connected to the computer and then causing a CPU or the like provided in the expansion board or the expansion unit to perform a part or all of the actual operations based on instructions of the program code.

This application claims the benefit of Japanese Patent Application No. 2005-159860 filed May 31, 2005, which is hereby incorporated by reference herein in its entirety.

What is claimed is:

1. An image forming apparatus comprising:

a paper feeding device that feeds a transfer material;

a length obtaining device that obtains a length in a feeding direction of the transfer material fed by said paper feeding device;

a receiving device that receives image data;

an image forming device that forms an image on a first side or a second side of the fed transfer material based on the image data received by said receiving device;

an inversion device that feeds the transfer material having the image formed on its first side until a part of the transfer material gets exposed outside the image forming apparatus and then feeds the transfer material to a refeeding path in the image forming apparatus to invert the transfer material;

a refeeding device that feeds the inverted transfer material to a standby position, at which a leading edge of the transfer material is stopped, the standby position indicating a position at which the transfer material is put on standby until a preparation for a next image forming process for the second side of the transfer material is completed;

a determining device that determines whether or not the preparation for the next image forming process is completed; and a refeeding controlling device that, in the case where the preparation for the next image forming process is not completed, changes the standby position along the refeeding path so that the leading edge of the transfer material is stopped at different positions along the refeeding path depending on the length in the feeding direction of the transfer material obtained by said length obtaining device, wherein the standby position is set farther downstream as the length of the transfer material is longer;

wherein said refeeding controlling device controls the transfer device not to stop at the standby position when said determining device determines that the preparation for forming the image on the second side of the transfer material is completed.

2. The image forming apparatus according to claim 1, wherein said refeeding controlling device stops the leading edge of the transfer material at a position where no part of the transfer material is exposed outside the image forming apparatus.

3. A control method for an image forming apparatus comprising:

a paper feeding step of feeding a transfer material;

a length obtaining step of obtaining a length in a feeding direction of the transfer material fed in said paper feeding step;

a receiving step of receiving image data;

an image forming step of forming an image on a first side or a second side of the fed transfer material with an image forming device based on the image data received in said receiving step;

an inversion step of feeding the transfer material having the image formed on its first side until a part of the transfer material gets exposed outside the image forming apparatus and then feeding the transfer material to a refeeding path in the image forming apparatus to invert the transfer material;

a refeeding step of feeding the inverted transfer material to a standby position, at which a leading edge of the transfer material is stopped, the standby position indicating a position at which the transfer material is put on standby until a preparation for a next image forming process for the second side of the transfer material is completed;

a determining step of determining whether or not the preparation for the next image forming process is completed; and a refeeding controlling step of, in the case where the preparation for the next image forming process is not completed, changing the standby position along the refeeding path so that the leading edge of the transfer material is stopped at different positions along the refeeding path depending on the length in the feeding direction of the transfer material obtained in said length obtaining step, wherein the standby position is set farther downstream as the length of the transfer material is longer;

wherein said refeeding controlling step controls the transfer device not to stop at the standby position when said determining device determines that the preparation for forming the image on the second side of the transfer material is completed.

4. The control method according to claim 3, wherein said refeeding controlling step stops the leading edge of the transfer material at a position where no part of the transfer material is exposed outside the image forming apparatus.

5. The image forming apparatus according to claim 1, further comprising:

a feeding path for feeding the transfer material from said paper feeding device, wherein when the transfer material has a predetermined length, said refeeding controlling device puts the transfer material on standby at a position downstream of a junction of the feeding path and the refeeding path.

6. An image forming apparatus comprising:

a paper feeding device that feeds a transfer material;

a length obtaining device that obtains a length in a feeding direction of the transfer material fed by said paper feeding device;

a receiving device that receives image data;

an image forming device that forms an image on a first side or a second side of the fed transfer material based on the image data received by said receiving device;

an inversion device that feeds the transfer material having the image formed on its first side until a part of the transfer material gets exposed outside the image forming apparatus and then feeds the transfer material to a refeeding path in the image forming apparatus to invert the transfer material;

a refeeding device that feeds the inverted transfer material to a standby position, at which a leading edge of the transfer material is stopped, the standby position indicating a position at which the transfer material is put on standby until a preparation for a next image forming process for the second side of the transfer material is completed; and a refeeding controlling device that, in the case where the transfer material stops at the standby position, changes the standby position along the refeeding path so that the leading edge of the transfer material is stopped at different positions along the refeeding path depending on the length in the feeding direction of the transfer material obtained by said length obtaining device, wherein the standby position is set farther downstream as the length of the transfer material is longer;

wherein said refeeding controlling device controls the transfer device not to stop at the standby position when said determining device determines that the preparation for forming the image on the second side of the transfer material is completed.

* * * * *